US008485169B2

(12) United States Patent
Dahl, II

(10) Patent No.: US 8,485,169 B2
(45) Date of Patent: Jul. 16, 2013

(54) SINGLE CAM COMPOUND BOW

(76) Inventor: William C. Dahl, II, Half Moon Bay, CA (US)

( * ) Notice: Subject to any disclaimer, the term of this patent is extended or adjusted under 35 U.S.C. 154(b) by 0 days.

(21) Appl. No.: 13/605,126

(22) Filed: Sep. 6, 2012

(65) Prior Publication Data

US 2012/0325195 A1 Dec. 27, 2012

Related U.S. Application Data

(62) Division of application No. 12/773,564, filed on May 4, 2010, now Pat. No. 8,281,773.

(60) Provisional application No. 61/175,419, filed on May 4, 2009.

(51) Int. Cl.
*F41B 5/10* (2006.01)

(52) U.S. Cl.
USPC ..... 124/25.6

(58) Field of Classification Search
USPC ..... 124/23.1, 24.1, 25.6, 86, 88
See application file for complete search history.

(56) References Cited

U.S. PATENT DOCUMENTS

| | | | | |
|---|---|---|---|---|
| 5,983,880 | A * | 11/1999 | Saunders | 124/25.6 |
| 6,655,371 | B2 * | 12/2003 | Gallops, Jr. | 124/25.6 |
| 6,722,354 | B1 * | 4/2004 | Land | 124/25.6 |
| 6,904,900 | B2 * | 6/2005 | Gallops, Jr. | 124/25.6 |

* cited by examiner

*Primary Examiner* — John Ricci
(74) *Attorney, Agent, or Firm* — David E. Newhouse, Esq.

(57) ABSTRACT

Improved compound archery bow features a cable guard that separates the crossing inside cable segments allowing the intersection locus of the crossing cable inside segments to freely glide through the guard as the bow is drawn and released, a dual cam power pulley having a power lobe cam presenting a power cable race spiraling outward on a side face of an elliptical draw lobe cam presenting a draw-lobe cable race where the power cable winds as the inside drawstring cable segment unwinds from around the power cable race of the power lobe cam, and the outside drawstring cable segment unwinds from and winds-up around the draw-lobe cable race of the elliptical draw lobe cam as the bow is drawn and released, and bow-limb mounting and limb-pod structures at the respective ends of the bow riser for anchoring, aligning and supporting extending bow limbs for flexure.

3 Claims, 14 Drawing Sheets

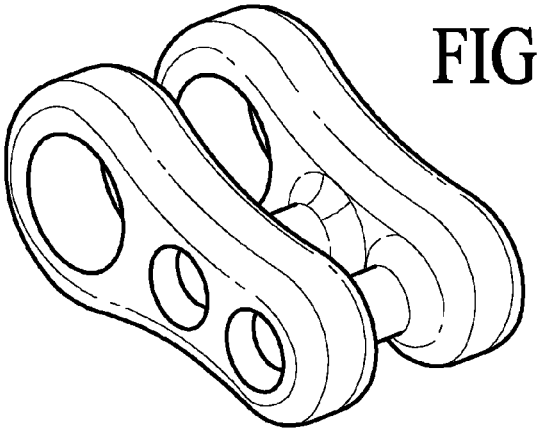
FIG.6
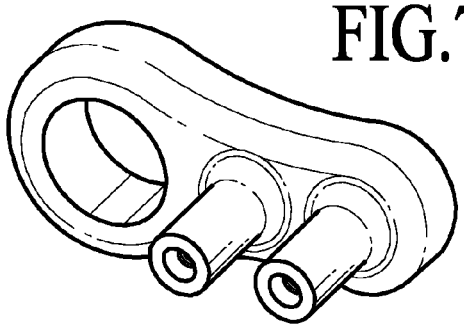
FIG.7
FIG.7a
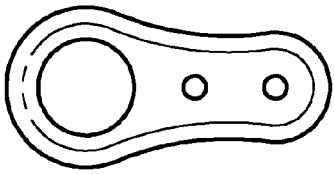
FIG.7b
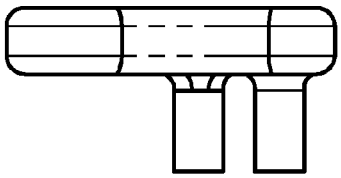
FIG.7c
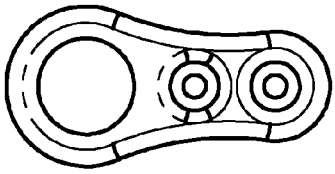

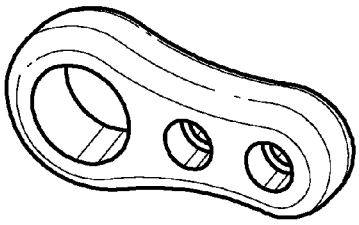
FIG.8
FIG.8a
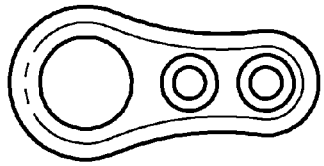
FIG.8b
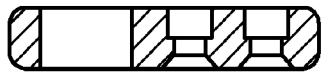
Section A-A
FIG.8c
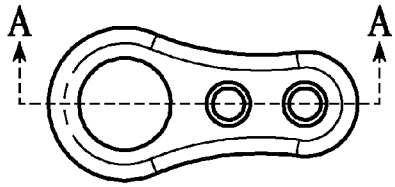
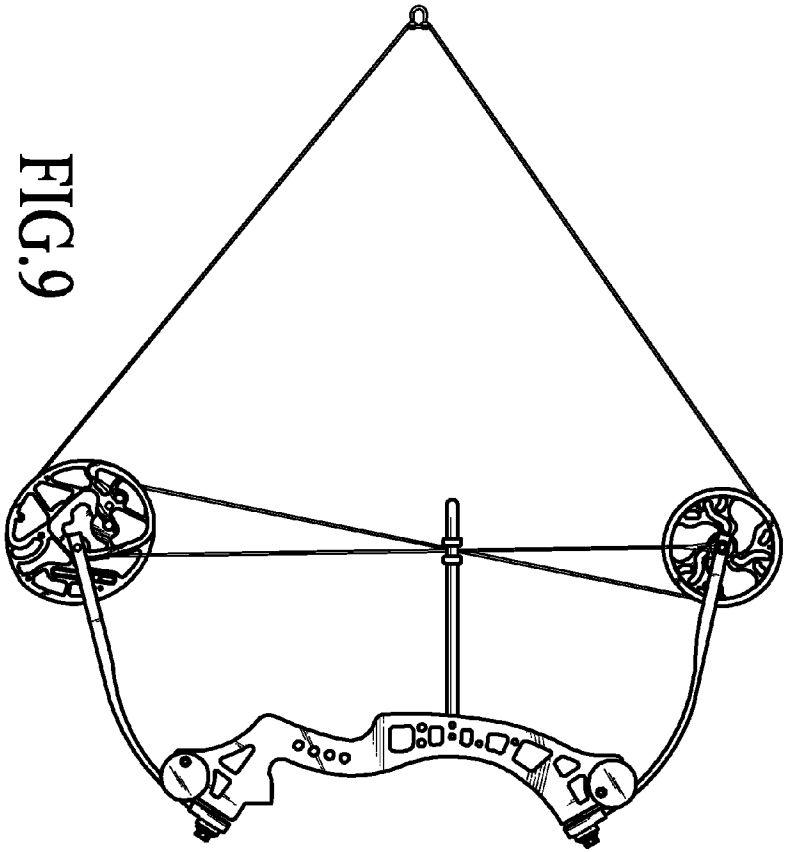
FIG.9

SINGLE CAM COMPOUND BOW

RELATED APPLICATIONS

This Application is a Divisional Application of U.S. Utility patent application Ser. No. 12/773,564. filed 4 May 2010 by the Applicant with other co-inventors and claims all applicable benefits under 35 U.S.C. §§120 & 121. This Application also claims all applicable benefits under 35 U.S.C. §119(e) relative to U.S. Provisional Patent Application Ser. No. 61/175,419 filed on behalf of the Applicant William C. Dahl II on 4 May 2009 entitled "Super Cable Guard Glide Slider for Compound Bows. U.S. Provisional Patent Application Ser. No. 61/175,419 is incorporated by reference in its entirety into this application.

BACKGROUND OF THE INVENTION

1. Field of the Invention

The inventions relate to features improving performance of compound archery bows, namely:

(i) cable guards that separate the intersecting crossing locus of the inside cables, allowing the cables to freely glide through the guard as the bow is drawn and released.

(ii) a dual cam power pulley for a single-cam compound bow with two lobed cable races wherein the power cable winds and unwinds as the inside drawstring cable segment unwinds and winds around a common lobed cable race; and (iii) mounting and limb-pod structures at the respective ends of the bow riser for anchoring, aligning and supporting extending bow limbs for flexure.

2. Description of the Prior Art

Modern compound bows typically include a rigid central, structural riser typically composed of alloys of aluminum, magnesium, and/or titanium, and a pair of resilient bow-limbs variously, mounted, anchored, and aligned extending from the opposite ends of the riser.

Single-cam compound bows have a single, power-cam pulley or bow eccentric (power cam) mounted and supported for rotation typically at the distal end of the lower extending bow limb and an idler or control pulley mounted and supported for rotation typically at the distal end of the upper of the extending bow limb. A power cable with a yoke end presenting a pair of loops typically is anchored around extending axle ends of the idler/control pulley at the distal end of upper bow limb. The other end of the power cable is anchored and journaled for winding around a lobed cam cable race of the power cam as the bow is drawn. The drawstring cable of a single-cam bow typically loops around the idler/control pulley with each cable end anchored to, and journaled for unwinding from around two separate lobed cam cable races of the power cam as the bow is drawn and released for launching an arrow. In some instances the ends of drawstring cable are respectively anchored between the bow limbs with one end journaled for unwinding from around a lobed cable race of the power cam and the other end unwinding from around a lobed cable race of the idler/control pulley. Still other embodiments contemplate looping the drawstring cable around the idler/control pulley and anchoring the cable within the periphery of the cable race dividing the cable into a drawstring segment and a control string segment. [See U.S. Pat. No. 6,666,202, Darlington.] Typically the power cable and the control segment of the drawstring cable (the inside cables) cross 'inside' between the drawstring cable segment and the riser. The crossing inside cables can and do often rub against each other as the single-cam compound bow is drawn and released.

Dual-cam compound bows have power cams mounted and supported for rotation at the distal ends of both the upper and lower extending resilient limbs of the bow. Two power cables each have one end anchored and journaled for winding around a lobed race of one of the respective power cams. The power cables typically have a yoke end presenting a pair of looped ends for anchoring around extending axle ends of the power cam on the opposite bow limb. The respective ends of the drawstring cable that launches arrows from the bow are anchored and journaled for unwinding from around lobed drawstring cable races of the respective power cams winding the respective power cables up around the power cable races of the power cams as the bow is drawn. Other embodiments contemplate a binary cam arrangement where the respective power cables each have both ends respectively anchored for winding and unwinding from around lobed cable races of the respective power cams, where, each power cable winds up around one power cam and unwinds from around the other power cam on the opposite bow limb as the is drawstring cable is drawn. [See U.S. Pat. No. 7,305,979, Yehle.] Typically, the power cable and the return segment cables) cross 'inside' the drawstring cable segment between it and the riser. As with single cam bows, the crossing inside cables of dual-cam compound bows can and often do rub against each other as the bow is drawn and released.

In both single and dual-cam compound bows the lobed cam races of the power cam upon which the drawstring and power-string cables wind and unwind are configured to vary the force resisting the draw of the drawstring cable of the bow for launching an arrow with the objectives of lessening the force required as the drawstring cable approaches a maximum (peak) draw position, while preserving the stored or potential energy of the drawn bow, and to tailor acceleration of a nocked arrow upon release of the drawstring.

Design aspects that affect performance of compound bows include the mounts securing the bow limbs to the riser, flexure and alignment of the bow limbs relative to the riser and each other such that the drawstring cable and the centerline of the assembled bow share a common plane. Also the bow limbs, power-cams and idler/control pulleys all must be synchronized, tuned balanced and aligned with the objectives of assuring a nocked arrow is accelerated linearly by the drawn drawstring cable upon release. Ideally, the bow limbs should flex evenly without twisting both as the bow is drawn and upon release for driving an arrow. The cam races of the respective power cams of dual-cam bows and the power cam and idler/control pulley of single cam bows should not induce any variances in either the vertical or horizontal positions of the nock position of the arrow on the released drawstring cable it accelerates the arrow from the bow.

Compound bows also necessarily include a cable guard rod mounted on the bow riser extending backward parallel the bowstring plane typically with a translating cable slider that captures the inside, crossing cables and holds them laterally out from the plane of the drawstring cable segment away from fletching of launched arrows. Typically the respective crossing inside cables are captured and in separate variously configured channels milled into solid pieces of low friction, ultra-high-molecular-weight (UHMW) polymer such as POM (Delrin®) or PTFT (Teflon®). However, as compound bows are drawn and released, the locus of the crossing intersection of the inside cables translates both horizontally back and forth and vertically up and down as the bow limbs flex in and spring apart launching arrows. The body of existing cable sliders between the respective milled cable channels capturing the cross inside cables constrain (prevent) the locus of crossing intersection of the inside cables from moving through the sliders, i.e., constrain vertical translation of the crossing intersection of the inside cables to either above or below the horizontal plane of a guard rod on-which the cable slider slides. In fact, as illustrated in FIG. 4, the force of the higher tensioned inside cable on the slider can bind and/or deflect the cable of the lower tensioned inside cable, as the locus of the crossing intersection approaches the vertical position of the guard rod on which the cable slide slides as the bow is drawn and released.

Also the crossing inside cables of most compound bows will rub against each other as the bow is drawn and released. Skewing asymmetrical stresses attributable to cable guard rods with constraining slides, and frictional stresses of rubbing crossing of inside strings compromise compound bow performance.

Compound bow are classified by the MANUAL OF PATENT CLASSIFICATION published by U.S. Patent Office generally in U.S. Class 124, subclass 25.6 with various means affecting performance of the bows being further classified in subclasses 23 R, 24 R, 86, 88 & 900. In particular, patents in U.S. Class 124/86 & 88 relate to means for securing bow limbs to the ends of the riser. Patents in U.S. Class 124/900 generally relate to limb tip rotatable element structures e.g., the power cams, idler/control pulleys/wheels and the like that provide the mechanical advantage as the bow is drawn and released. The designated class specified by the International Patent Classification protocols for compound bows and their features is F41B 5/10.

SUMMARY OF THE INVENTION

A single-cam, compound bow is described with the following functional improvements:

a) a cable guard with a pair of glide axles that separate the crossing locus of inside cables allowing the inside cables to freely glide vertically and horizontally through the cable guard without rubbing as the bowstring cable segment is drawn and released.

b) a dual cam power pulley having a power-lobe cam cable race and a draw-lobe cam cable race wherein the power cable winds and then unwinds from, and the inside segment of the drawstring cable unwinds from and then winds around a power lobe cable race as the drawstring cable unwinds from, and then winds around the draw lobe cam cable race of the pulley respectively as the bow is drawn and then released;

c) a limb pod cradle structure oriented transversely across the back of each end-mount of the riser body receiving, and aligning the respective bow-limbs containing a cylindrical core of an ultra-high-molecular-weight (UHMW) polymer/plastic for providing a low friction, hemicylindrical flexure surface around which the bow-limbs flex as the bow drawn and released; and d) an improved limb-top, trim structure that includes an annular hemispherical swivel cradle around an anchor hole that registers with a threaded bolt receptacle penetrating deeply into each front end face of the riser body and an anchor bolt having a long threaded shank with s swivel washer nesting within the annular hemispherical seating cradle pivotally anchoring slotted ends of the bow limbs at the ends of the riser body for flexure around the low friction, hemicylindrical flexure surfaces of the limb pod cradle structures.

BRIEF DESCRIPTION OF THE FIGURES

FIG. 6 is a perspective view of an assembled an improved cable slide adapted to translated back and forth on a cable guard rod.

FIG. 7 is a perspective view of the male component of the improved cable slide shown in FIG. 6.

FIGS. 7*a*-7*c* respectively present top, side and bottom views of the male cable slide component shown in FIG. 7.

FIG. 8 is a perspective view of the female component of the improved cable slide shown in FIG. 6.

FIGS. 8*a*-8*c* respectively present top, bottom and side section views of the female cable slide component shown in FIG. 8.

FIG. 9 is a right side elevation view of a compound bow with the cable glide translating on the cable guard rod separating and holding the crossing inside cables to the right side with the drawstring cable drawn.

DESCRIPTION OF PREFERRED AND EXEMPLARY EMBODIMENTS

Figure 1:
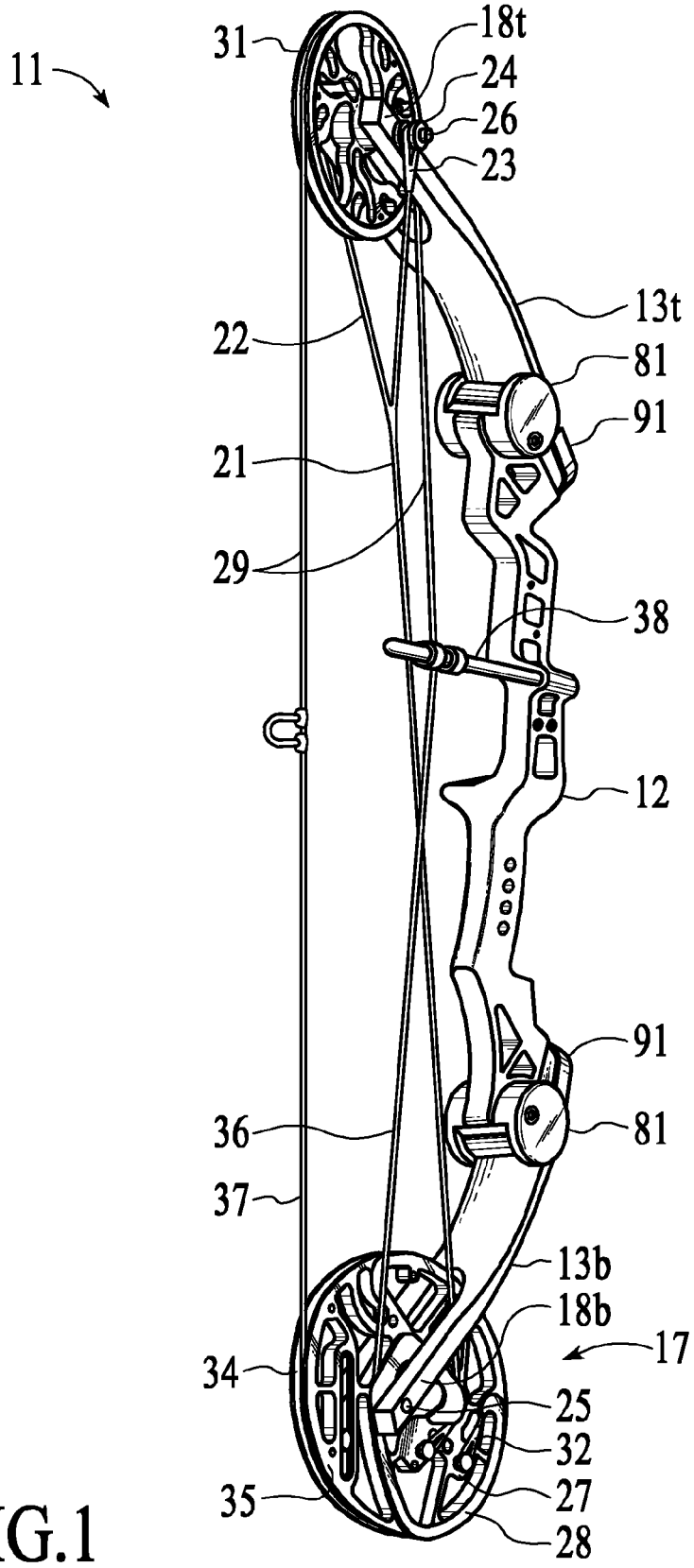
FIG. 1 is a rear perspective view of a single-cam compound bow with the improved functional features as viewed obliquely from the right, behind the bow.

FIGS. 1-3, 5*c*, 14 & 15 each show a strung, single-cam compound bow 11 at the brace position that includes a rigid, structural riser body 12 with a pair of matched resilient bow limbs 13*t* & 13*b* with slotted anchor ends 14 (FIG. 12) respectively anchored at top and bottom, bow-limb mount faces 16*t* & 16*b* (FIG. 13*a* & 13*b*) of the riser body 12. A dual cam power pulley 17 (see FIGS. 3, 4, 9, 10*a*, & 10*b*) is supported by an axle 25 for rotation within a yoke 18*b* at the extending distal end of the bottom bow limb 13*b*. A conventional idler/control (radial) pulley 19 is supported by an axle 26 for rotation within a yoke 18*t* at the distal of the top bow limb 13*t*. A conventional power cable 21 and a drawstring cable 29 of the bow 11 are tensioned at an initial brace (undrawn) state by flexure of the anchored bow-limbs 13*t* & 13*b*. A pair of end loops 23 at the yoke end 22 of the power cable 21 are conventionally anchored around the extending ends 24 of the idler/control pulley axle 26. The cam end 27 of the power cable 21 is anchored to, and journaled for winding-up around cable race 30 of the power-lobe cam 28 of the dual cam power pulley 17. The drawstring cable 29 loops around cable race 31 of the idler/control pulley 19. The inside end 32 of the drawstring cable 29 is anchored and journaled for unwinding from around cable race 30 of the power lobe cam 28 of the dual cam power pulley 17. The outside end 33 of the drawstring cable 29 is anchored and journaled for unwinding from around cable race 34 of the draw lobe cam 35 of the dual cam power pulley 17. The inside cable segment 36 of the drawstring cable 29 and the power cable 21 (the inside cables) cross 'inside' between the drawstring cable segment 37 of the drawstring cable 29 and the bow riser below the plane of a cable guard rod 38 mounted on the bow riser 12 and extending backward, parallel the draw and release plane of the drawstring cable segment 37, (conventionally referred to as the central reference plane of the bow 11).

The crossing inside cables 21 & 36 thread through a pair of spaced parallel glide-axles 41 & 42 of a cable glider 39 secured on the cable guard rod 38 (FIGS. 5*a*, 5*b* & 5*c*), or a cable slider 40 (FIGS. 6 & 9) sliding back and forth horizontally on the cable guard rod 38. The spaced glide axles 41 & 42 of both the cable glider 39 and the cable slider 40 hold the crossing inside cables 21 & 36 laterally out from the plane of the drawstring cable segment 37 away from fletching of launched arrows. More precisely the spaced pair of parallel glide-axles of the glider 39 (FIG. 5*c*) or slider 40 (FIG. 9) are parallel to the central reference plane of the bow 11, and incline the respective locus planes of the crossing inside cables 21 & 36 angularly apart and out from the central reference plane of the bow 11 sufficiently as to not interfere with drawing and releasing of the drawstring cable segment 37 launching arrows.

Inclining or tilting the respective locus planes of the crossing inside cables 21 & 36 angularly apart precludes the crossing inside cables 21 & 36 from rubbing against each other at the locus of their crossing intersection, i.e. separates the cables. In particular, at the bottom end of the bow 11, the crossing inside cables 21 & 36 are located in a common plane (ideally the central reference plane of the bow 11) as they oppositely wind around and unwind from around the cable race 30 of the power-lobe cam 28 of the dual cam power pulley 17. Likewise, at the top end of the bow 11, the crossing inside cables 21 & 36 are located in a common plane (again ideally the central reference plane of the bow) by the cable race 31 of the idler/control pulley 19 and the yoke end 22 of the power cable 21 with loops 23 anchoring around the extending ends 24 of the axle 26 of the idler/control pulley 16. Also, appreciate that the planes of the respective cable races, 31 of the idler/control pulley 19, 34 of the draw-lobe cam 35 of the dual cam power pulley 17 preferably lie and rotate in a common plane (again ideally the central reference plane of the bow 11). Further, appreciate that the crossing inside cables 21 & 36 are spaced apart in common planes at the respective distal ends of the bow 11. The spaced pair of parallel axles 41 & 42 of the cable glide 39 secured to, or the cable slide 40 sliding on the cable guard 38 holding the inside cables 21 & 23 angularly out from the central reference plan of the bow 11 thus establish inclined locus planes for the respective inside cables 21 & 36 that tilt out from the bow ends at different angles determined by the spacing between pair of glide-axles 41 & 42 around which the respective cables are trained. Accordingly, the loci or paths of the inside cables 21 & 36 spread further apart as they approach the spaced pair of parallel axles 41 & 42 hence preclude any contact at the locus of the crossing intersection of the inside cable 21 & 36 as the bow is draw and released.

As the bow 11 is drawn, the drawstring cable segment 37 unwinds from around the cable race 34 of the draw-lobe cam 35, and the inside cable segment 36 of the drawstring cable 29 (carried around the cable race 31 of idler/control pulley 19) unwinds from around the cable race 30 of the power-lobe cam 28 simultaneously winding up the power cable 21 around cable race 30 of the power-lobe cam 28 of the dual power cam pulley 17. The locus of the crossing intersection of the inside cables 21 & 36 rises vertically relative to the plane of the cable guard rod 38 and translates horizontally backward as the bow limbs 13*t* & 13*b* flex together. The parallel inside and outside glide-axles 41 & 42 of either the cable glider 39 or the cable slider 40 separate and hold the crossing inside cables 21 & 36 away from the plane of the drawstring cable segment 37, each being aligned in the respective inclined locus plane of the particular inside cable 21 or 36 and allow the crossing intersection locus of the, inside cables 21 & 36 to freely translate horizontally and vertically up into, around and through the cable glider 39 or cable slider 40 (FIG. 16).

Upon release of the drawstring cable segment 37 from the fully drawn position for launching an arrow, the released drawstring cable 29 winds up both around the cable race 34 of the draw-lobe cam 35 and the cable race 30 of the power-lobe cam 28 of the dual power cam pulley 17 as the inside power cable 21 unwinds from around cable race 30 of the power-lobe cam 28 responsive to the bow limbs 13*t* & 13*b* springing back to the initial brace position. The locus of the crossing intersection of the inside cables 21 & 36 descends vertically relative to the plane of the cable guard rod 38 and translates horizontally forward freely down into, around and through the cable glider 39 or cable slider 40 (FIG. 9)

In short the glide axles of the cable glider 39 and the cable slider 40 supported by the guard rod 38 address and solve primary performance and design issues afflicting "short axle" length or compact "parallel" compound bows, namely stresses vibrations induced by rubbing contact of the skewed-out inside bow cables on release, and constraints imposed by cable guards that limit the location of the crossing locus of the inside cables to either above or below the horizontal position of the guard rod as the bow is drawn and released. (Compare FIGS. 4, 5*c* & 9.) The skilled bow designer and shooter should appreciate that a cable guard slider closer to the pivot position of the riser bow grip (and the horizontal launch plane of an arrow) decreases differential torque due to the skewed inside cables tensioned by the bow limbs that tends to rotate the central reference plane of the bow sideways. Also a cable guard system that constrains the crossing locus of the inside crossing cable to either above or below a particular mount position on the riser limits the draw of the bow.

Figure 5A:
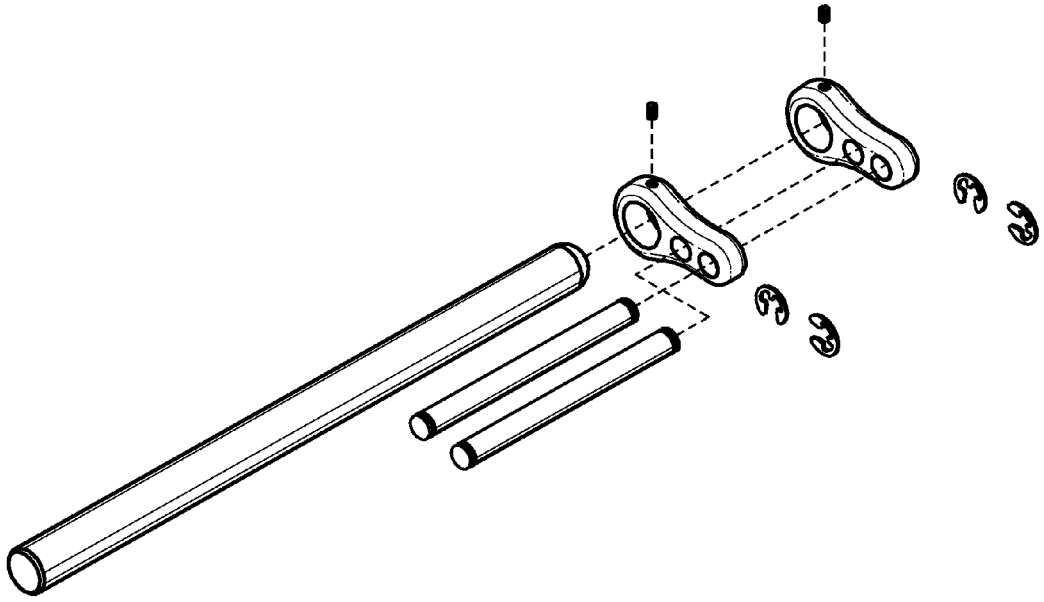
FIGS. 5*a*, 5*b* & 5*c* respectively present an exploded component view of the cable glider, an assembled perspective view of the cable guider and a left side elevation view of a compound bow with the cable glider secured to a cable guard rod for separating and holding the inside crossing cables to the right side with the drawstring cable undrawn.
Figure 5B:
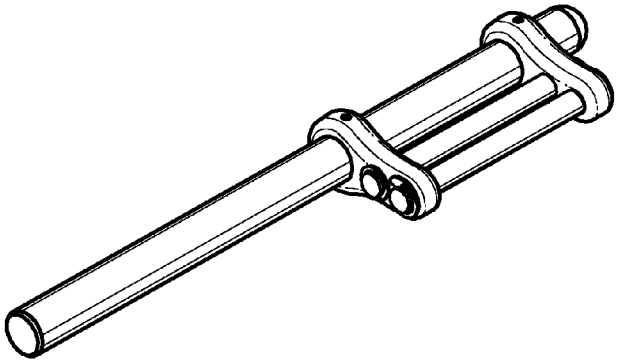
Figure 5C:
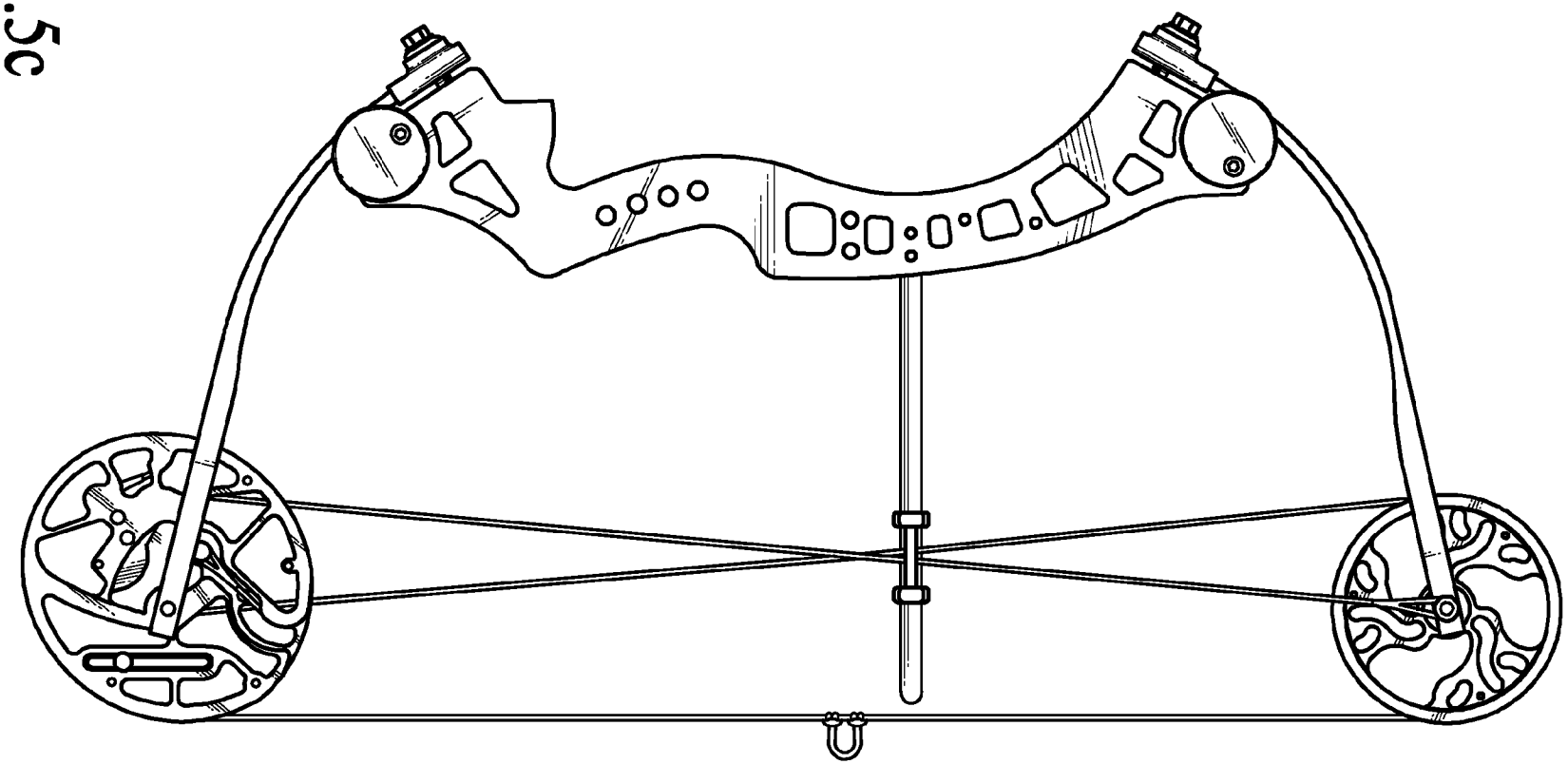

With reference to FIGS. 5*a*, 5*b* & 5*c*, the cable glider 39 includes a pair axle mounts or holders 51 adapted to be mounted and fixed in place with set screws 52 on a cable guard rod 38. Two glide axles 41 & 42 are mounted and supported in a spaced parallel relationship with each other and with the cable guard rod 38 between the two axle mounts 51. Ear clips 53 received in annular grooves 54 at the respective ends of the axles 41 & 42 secure the axles in the axle mounts 51. The length of the cable race 56 between the axle mounts 51 should at least be equal to the distance the crossing inside cables 21 & 36 of the bow translate back and forth in the plane of the cable glide axles 51 secured on the guard rod 38 holding the crossing inside cables 21 & 36 apart and out from the reference plane of the bow as the bowstring cable segment 37 is drawn from a brace position to, and released at a drawn position.

With reference to FIGS. 6, 7, 7*a*-7*c*, 8, 8*a*-8*c* & 9, the cable slider 40 includes two elements, a male element 61 with two integral, parallel, spaced, extending, glide-axles 41 & 42, and a female element 62 with two glide-axle receptacles 63 dimensioned for snugly receiving the distal glide-axle ends 64 of the male element 61. A cable guard rod slide port 66 is drilled though the base of male and female elements 61 & 62 dimensioned for freely sliding back and forth on the cable guard rod 38 (FIG. 9). As illustrated, the glide-axles 41 & 42 of the cable slider 40 are preferably annular cylinders. Screw ports 66 are drilled, coaxially though the bottom of the post receptacles 64 (FIG. 8*c*) allowing the male and female elements 61 & 63 to be fastened together with conventional flat head screws (not shown) dimensioned for screwing into the hollow centers of the annular glide-axle ends 64. Alternatively, the glide-axle ends 64 and receiving receptacles 63 may be appropriately configured and dimensioned for a snug compression fit to securing the male and female elements 61 & 63 of the cable slide 40 together. Since the cable slide is free to slide back and forth on the cable guard rod, the length of the cable race 67 should at least equal to maximum spread of the crossing inside cables 21 & 36 in the plane of the of the glide-axles 41 & 42 as the drawstring cable segment 37 is drawn and released.

Figure 10A:
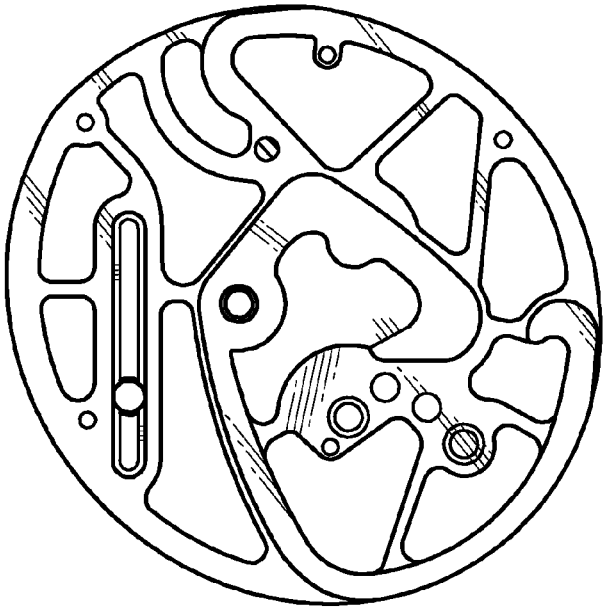
FIG. 10*a* is a right side elevation view of the dual cam power pulley showing the respective power lobe and draw lobe cam configurations of the cable races and cable anchor posts.
Figure 10B:
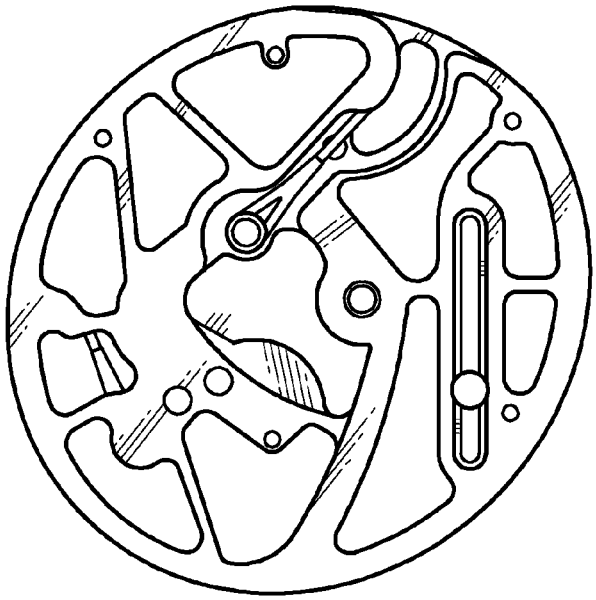
FIG. 10*b* is a left side elevation view of the dual cam power pulley showing the draw lobe cam configuration of the draw cable race and cable anchor post.
Figure 10C:
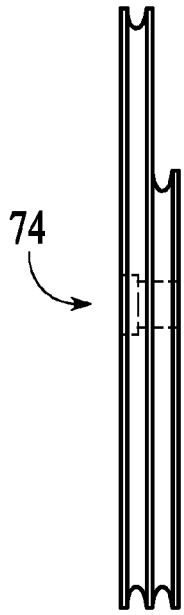
FIG. 10*c* is an edge view of the dual cam power pulley showing the dual cable races of the lobed cams.

With reference to FIGS. 10*a*, 10*b* & 10*c*, the dual cam power pulley 17 is conventionally machined from a single piece of a light structural metal such as titanium or aluminum using digital or computer numerically controlled (CNC) machines. As illustrated the dual cam power pulley 17 includes a power lob cam 28 presenting a cable race 30 spiraling outward on the right side face of an elliptical draw lobe cam 35 presenting cable race 34. The dual cam power pulley 17 also includes a conventional axle bearing 68 offset from the center of the pulley 17 journaled for rotation around the axle 25 at the distal yoke end 18*b* of the bottom bow limb 13*b*. The cam end 27 of power cable 21 is conventionally anchored around anchor post 72 for winding counter-clockwise around the cable race 30 of the power lobe cam 28 as the bow is drawn rotating the power cam pulley 17 clockwise. The inside end 32 of the drawstring cable 29 is conventionally anchored around anchor post 73 for unwinding from and winding up around cable race 30 of power lobe cam 28 as the bow is drawn and released. The outside end 33 of the drawstring cable 29 is conventionally anchored around anchor posts 74 (FIG. 10*b*) journaled for unwinding from and winding up around cable race 34 of draw lobe cam 35 as the bow is drawn and released. A conventional adjustable stop or draw limit trigger post 76 is movable in shouldered slot 77 milled into the right side face of the pulley 17. The trigger post 76 seats on the left side face of the of the dual cam power pulley 17 and extends perpendicularly out to engage or strike the left yoke arm of the bottom bow limb 13*b* as the bow drawn from the brace position rotating the pulley 17 to establish the fully drawn position of the bow.

Figure 2:
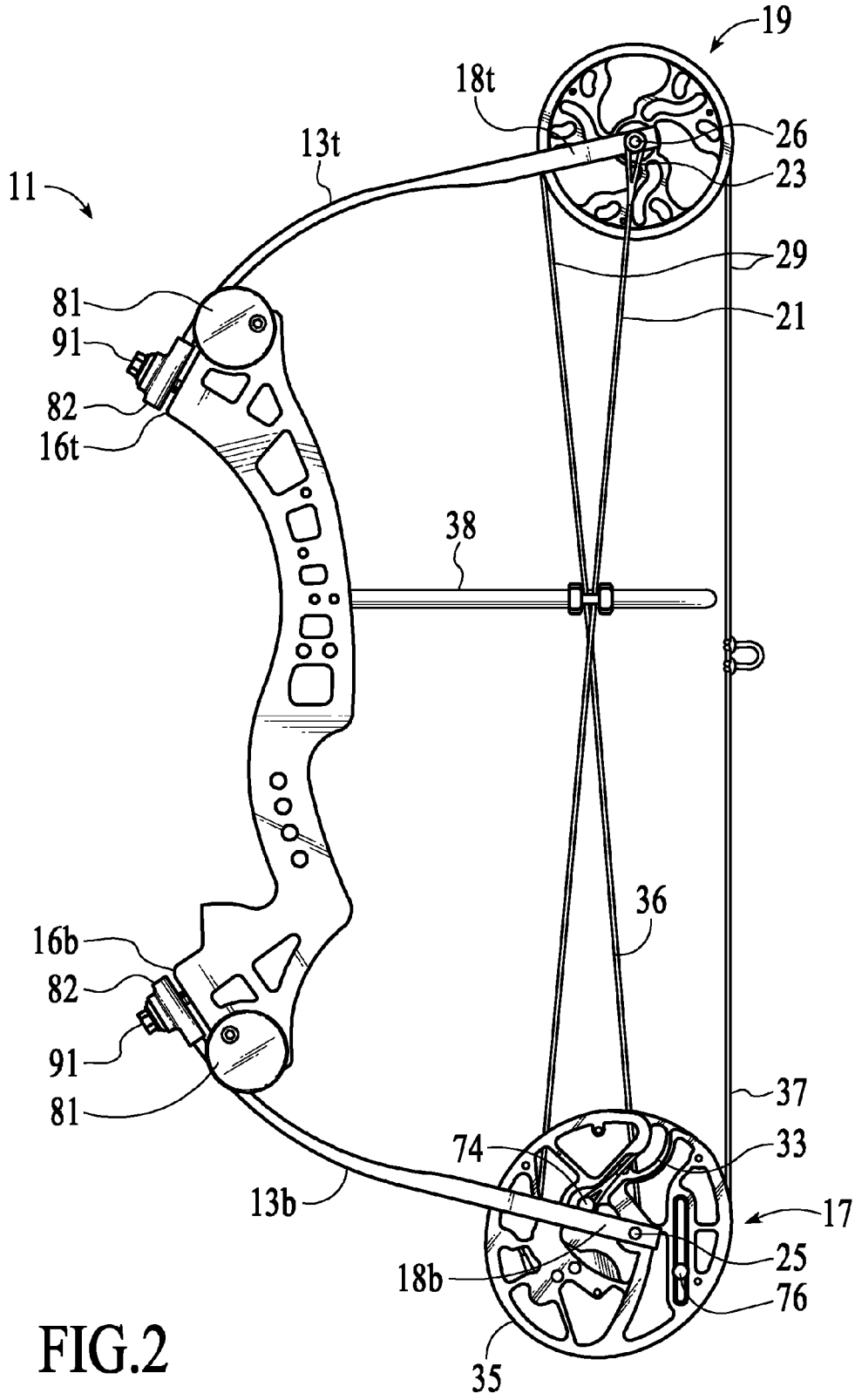
FIG. 2 is a left side elevation view of the improved single-cam compound bow with the drawstring cable undrawn.

In particular, looking at FIGS. 2, 10*a*, & 10*b* the draw limit post 76 is conventionally secured at a particular position by an allen cap screw 78 seated on the shoulder within the slot 77. The shank of the allen cap screw 78 extends through the slot and coaxially threads in to the base of the post 76 that in turn has a diameter greater than the width of the slot 77. The head of the cap screw 78 seats on the shoulder within the slot 77 and does not extend out into the plane of the cable race 30 of the power lobe cam 28 of the dual cam power pulley 17.

Figure 3:
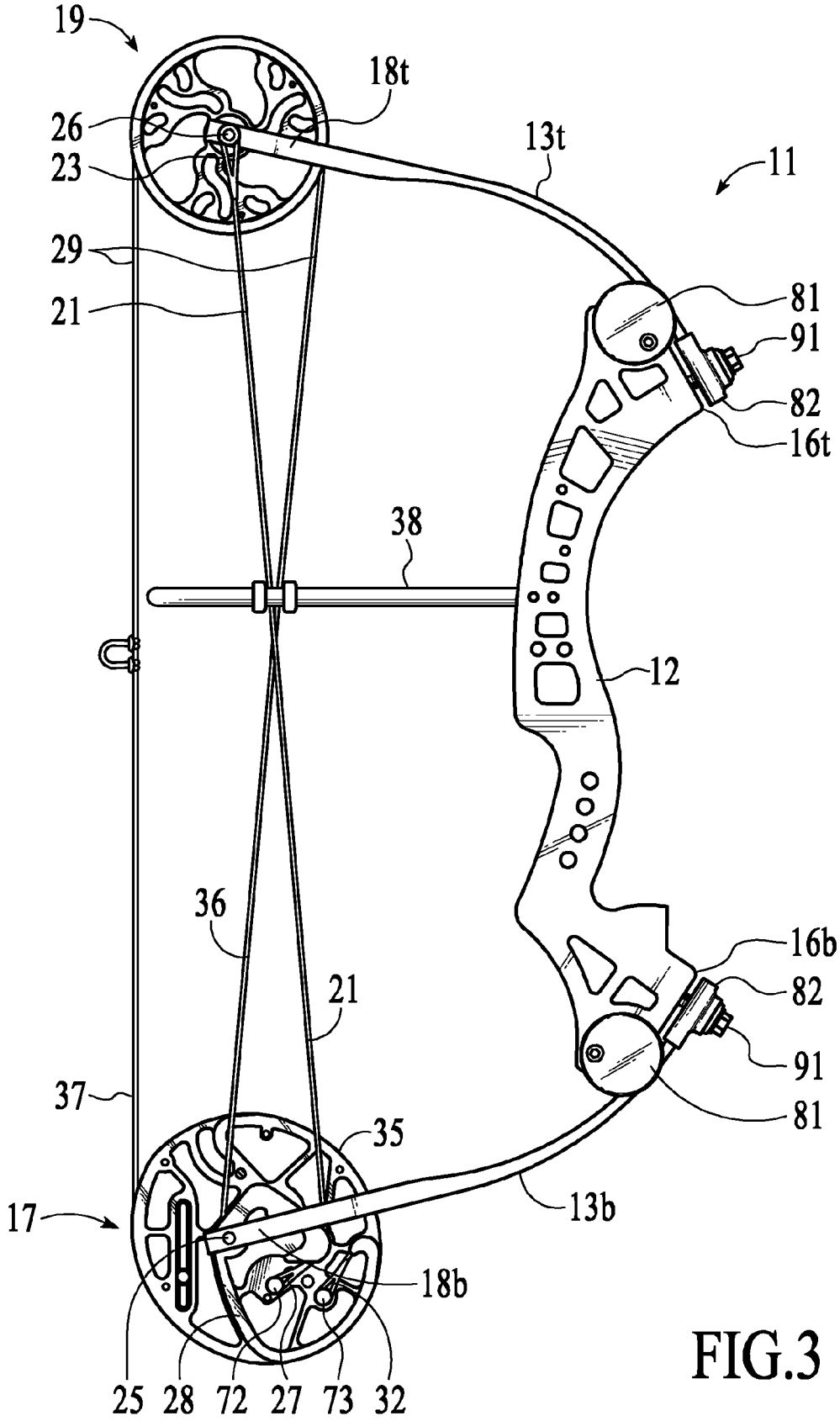
FIG. 3 is a right side elevation view of the improved single-cam compound bow with the drawstring cable undrawn.
Figure 4:
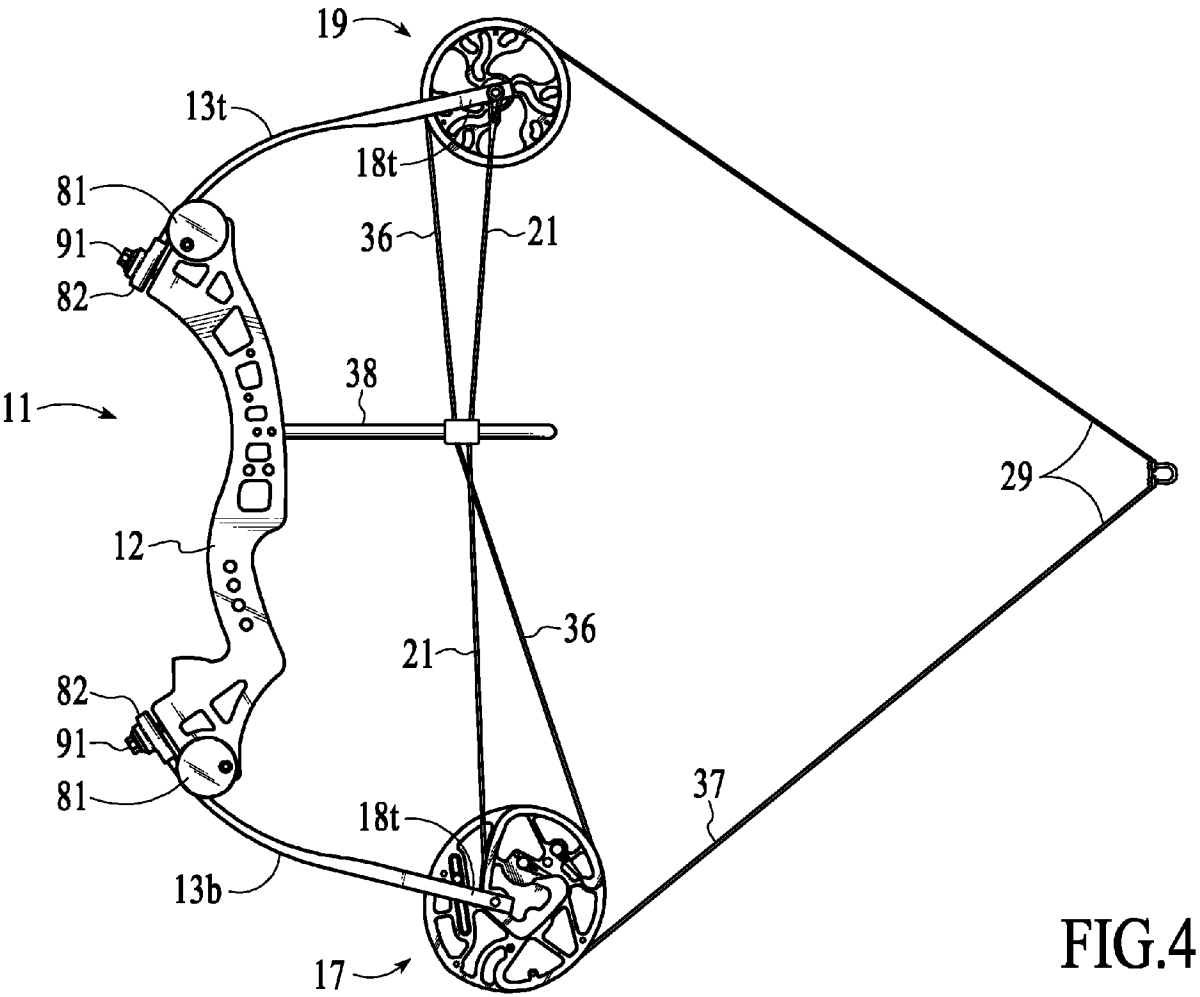
FIG. 4 is a right side elevation view of the improved bow with a conventional cable slider capturing the inside cables that constrains the locus of the crossing intersection of the inside cables below the horizontal plane of the cable guard rod with the drawstring cable drawn.

Comparing FIGS. 3, 4 and 9 showing the bow 11 respectively at the brace position (FIG. 3) and the drawn position (FIGS. 4 & 9), note that the cable segment 36 of drawstring cable 29 spirals outward in cable race 30 from the rotation axis to the periphery of the dual cam power pulley 17 while power cable 21 spirals inward in cable race 30 path toward rotational axis in cable race 30 of the pulley 17 as the bow is drawn. The drawstring cable segment 37 of the drawstring cable 29 unwinds at the periphery of the in the race 34 of draw lobe cam 35 at increasing radial distance from the rotation axis of the pulley 17. In short, as the bow 11 is drawn, mechanical advantage of the drawstring cable 29 increases while that of the power cable 21 decreases as the tangential position of the power cable 21 in cable race 30 approaches the rotation axis of the pulley. At the fully drawn position (FIG. 9) the describe dual cam power pulley 17 provides maximum mechanical advantage to the drawstring cable 29 and minimum mechanical advantage to the power cable 21 thus decreasing the force (draw weight) required to hold the drawstring cable 29 at (peak) drawn position.

It should also be noted that respective circumferential lengths of the drawstring cable segments 36 & 37 of the drawstring cable 29 unwinding from, and winding around the respective lobe cam races 30 & 34 of the dual cams 28 & 35 must be equal at all times as the bow is drawn and released, otherwise the nock position of an arrow on the released outside drawstring cable segment 29 will vertically translate up and/or down in the plane of the drawstring cable 29 as it is wound up around the dual cams 28 & 35, powered by the bow limbs 13*t* & 13*b* flexing apart, accelerating an arrow from the bow 11.

Figure 11A:
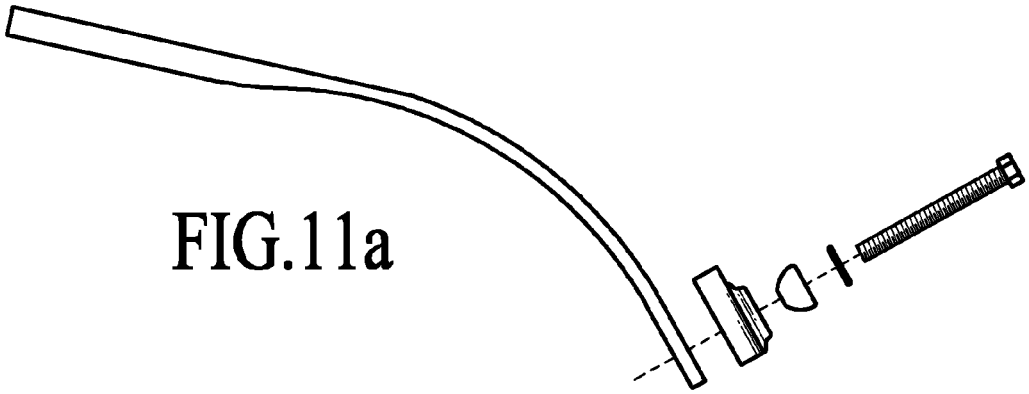
FIG. 11*a* is an exploded side elevation view of a bow limb, an improved limb-top trim structure, and, a swivel washer, a resilient washer and an attachment bolt.
Figure 11B:
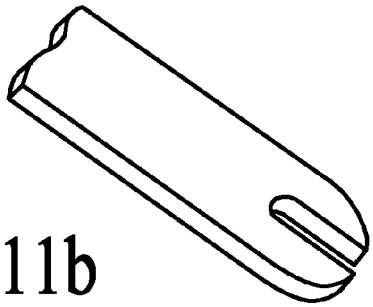
FIG. 11*b* is a perspective view of the inside of the limb-top trim.
Figure 11C:
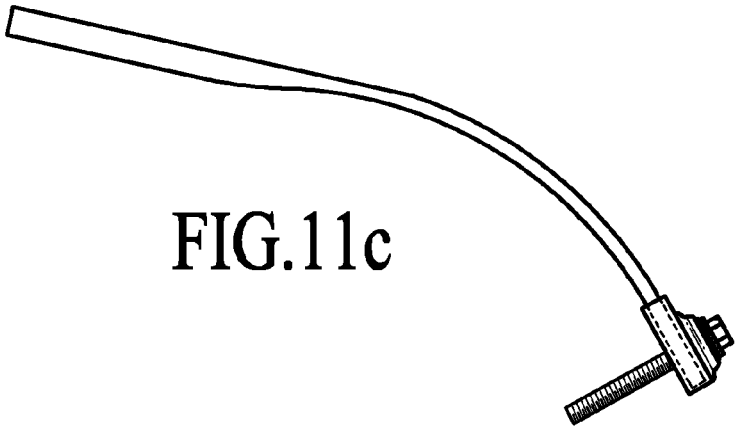
FIG. 11*c* is an assembled side elevation view a bow limb and the improved limb-top trim, the anchor bolt and washers.

Turning now to FIGS. 11*a*-11*c*, and FIG. 12, the slotted anchor ends 14 of a matched pair of bow limbs 13*t* & 13*b* are respectively anchored at the respective at the top and bottom mount faces 16*t* & 16*b* of the bow riser body 12 by a combination of tension of the power and drawstring cables 21 & 29, flexing the bow limb 13*t* & 13*b* around an aligning limb pod cradle structure 81, and the limb-top trim structures 82. As shown in FIG. 11*b*, the limb-top trim structures 82 has a downward extending wall 83 defining and anchor bay 84 sized and configured for snugly receiving the slotted anchor end 14 of a bow-limb 13. An anchoring port 86 with a surrounding, topside, concave annular hemispherically swivel cradle 87 communicates through the limb-top trim structure 82 located and sized for registering with an underlying, threaded, bolt hole 88 drilled deeply into the riser body 12 at the front of the respective top and bottom riser bow-limb mount faces 16*t* & 16*b*. A convex spherically shaped, swivel washer 89 is received and swivels within the annular concave hemispherically swivel cradle 86 sized to receive a long shank bow-limb attachment bolt 91 that screws into the underlying, threaded, bolt hole 88 for pivotally coupling the slotted anchor ends 14 of bow-limbs 13*t* & 13*b* to the top and bottom bow-limb mount faces 16*t* &16*b* of the riser body 12.

The skilled compound bow designer should note and appreciate that combination of the limb-top trim structure 82, swivel washer 89 and attachment bolt 91 only couples the slotted anchor ends 14 of the bow limbs 13*t* & 13*b* to the riser body 12. In particular, each bow limb 13*t* & 13*bt* extends rearward and is comfortably received seating between aligning shoulders 92 of the limb pod cradle structure 81 for flexure around a convex hemicylindrical surface of a limb-pod cylinder 93 seated in the limb pod cradles 81. (See FIGS. 14 & 15). The slotted anchor ends 14 of the bow limbs 16*t* & 16*b* are free to pivot on the head the attachment bolts 91, as the bolts 91 are screw in and out of the deep, threaded bolt holes 88 penetrating into the riser body 12 for adjusting the degree of brace flexure of the bow limbs 13*t* & 13*b* tensioning the power and drawstring cables 21 & 29, setting rate of spring back from the drawn position launching an arrow.

The skilled compound bow designer should also appreciate that tension of the power and drawstring cables 21 & 29 at the brace position can be completely relieved by simply unscrewing the attachment bolts 91 allowing for field replacement of both the bow limbs 13*t* &13*b* and cables 21 & 29. In other words, it is the combination of the attachment bolts 91 holding the limb-top trim structures 82 receiving and capturing the slotted anchor ends 14 of the bow limbs 13*t* &13*b* for tensioning of the power and drawstring cables 21 & 29 carried by the pulleys 17 & 19 at the distal ends of the bow limbs that allows an archer to disassemble and reassemble the component parts the bow 11 in the field.

Figure 12:
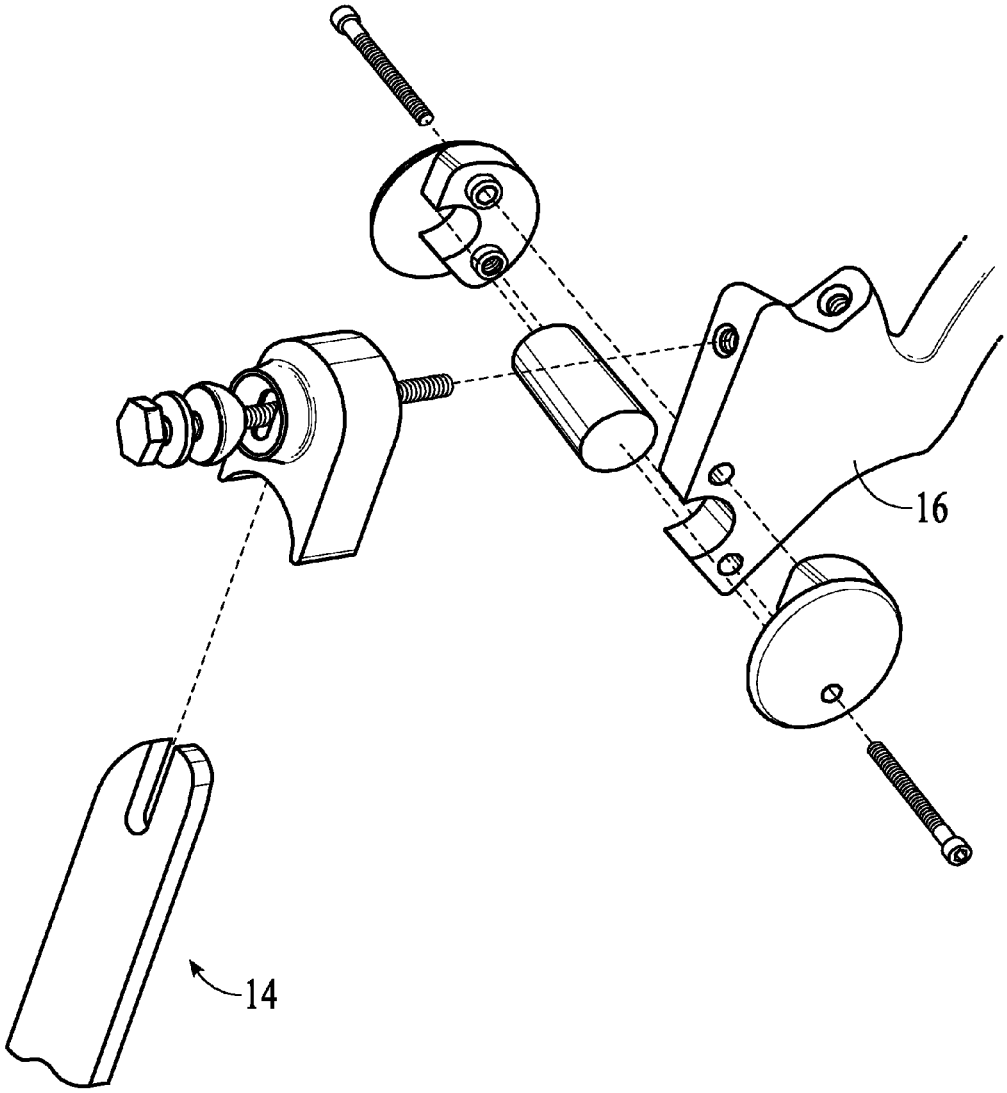
FIG. 12 is an exploded perspective view illustrating the assembly of the bow limb, the improved limb-top trim structure, washers and attachment bolt, and the elements of the limb pod-cradle structure and limb-pod cylinder coupling and aligning the bow limbs for flexure at the bow-limb mount ends of the bow riser body.
Figure 13A:
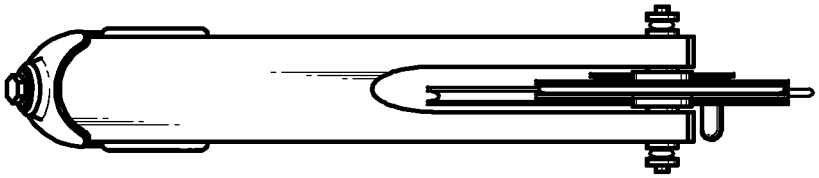
FIGS. 13*a* and 13*b* are respectively top and bottom plan views of the bow
Figure 13B:
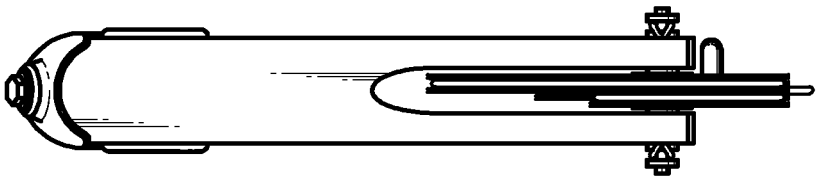
Figure 14:
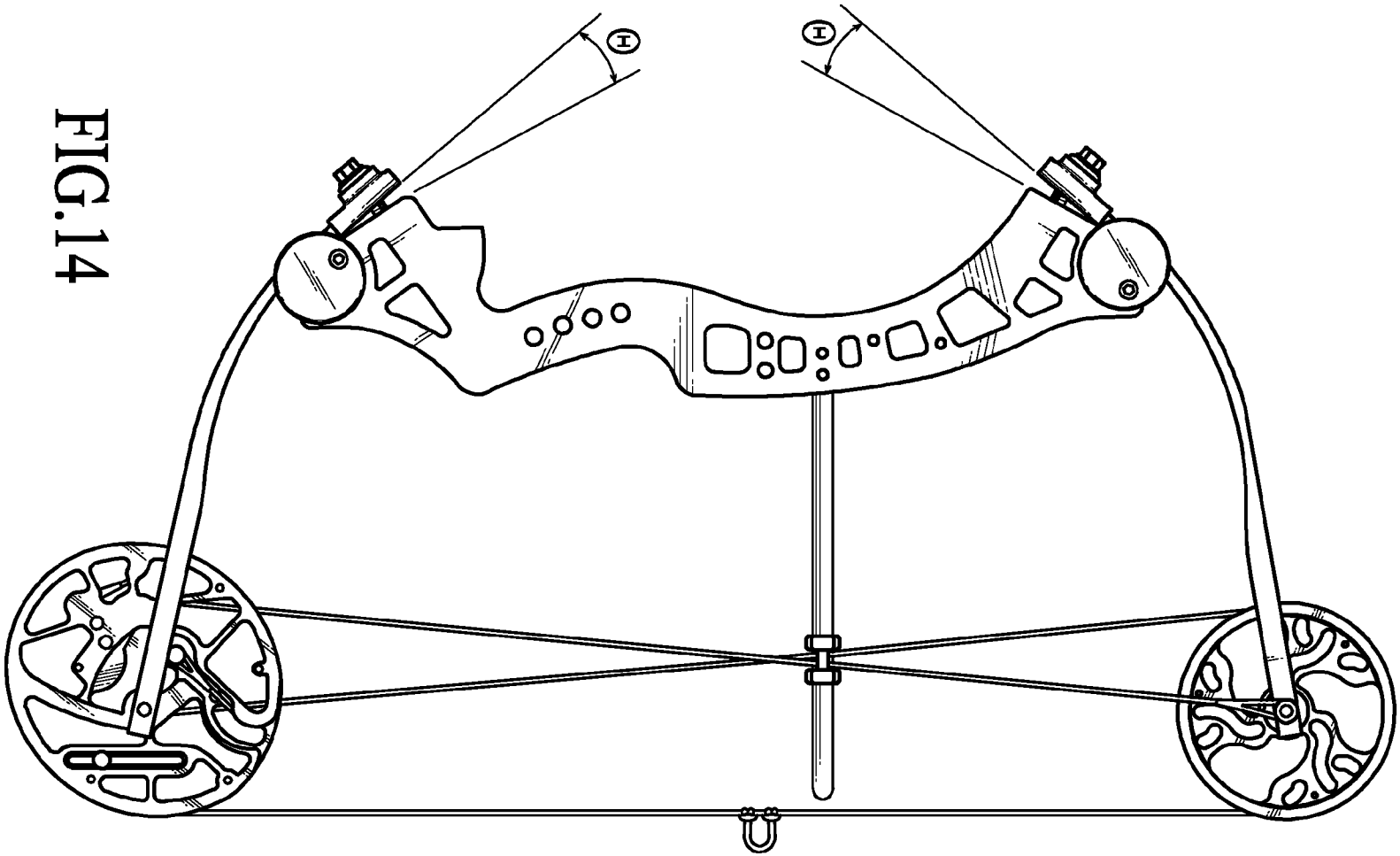
FIGS. 14 & 15 are left side elevation views of the improved single-cam compound bow with the attachment bolt adjusted respectively for a high draw-weight (force) and for a low draw-weight (force).
Figure 15:
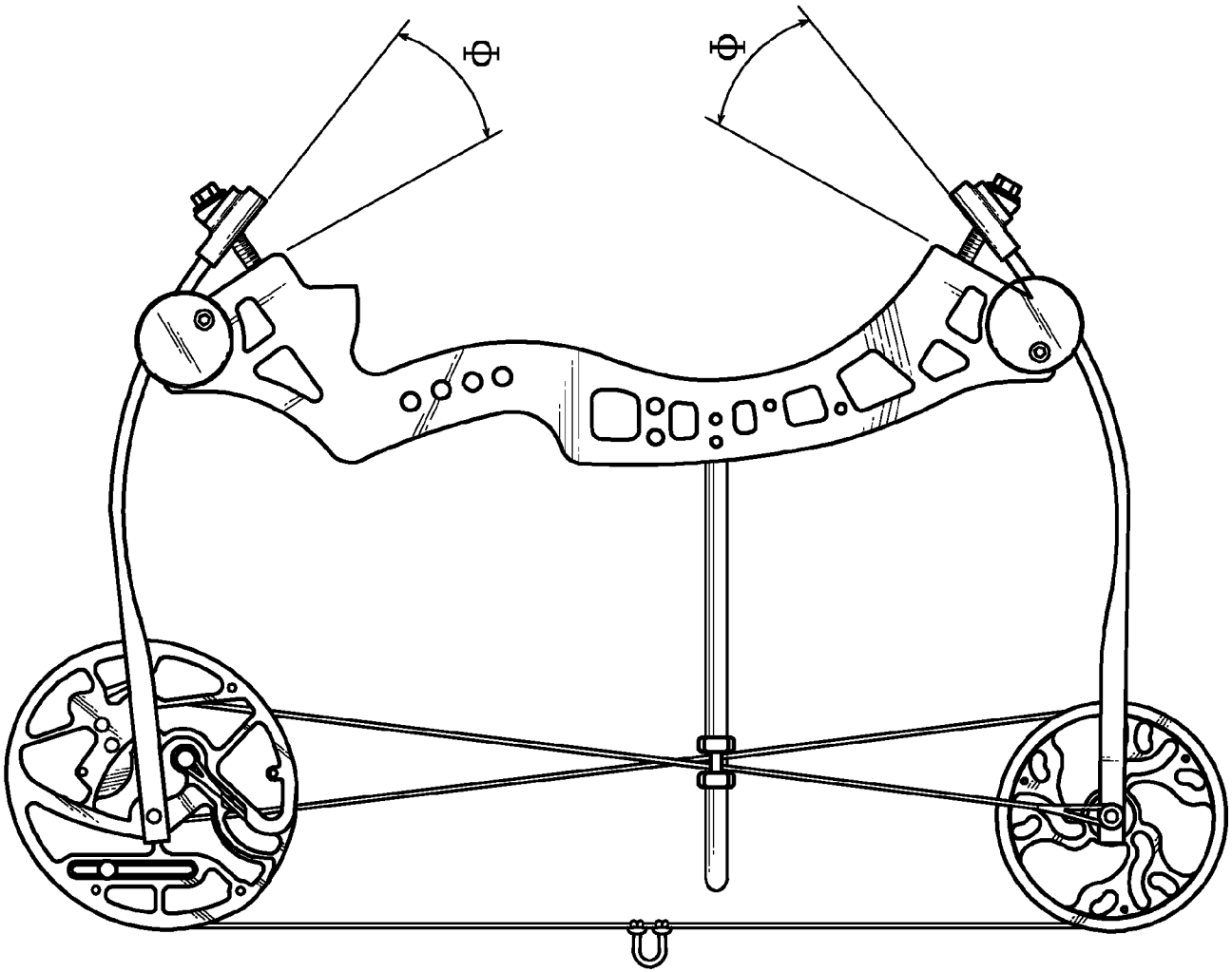

In more detail, looking at FIGS. 12, 13*a* and 13*b* the limb-pod cradle structure 81 comprises a combination of a transverse concave semi-cylindrical relief 94 cut into the surface, at the back of a riser body mount face 16 with a pair of reflectively symmetrical, shouldered, concave, semi-cylindrical ear structures 96 coaxially positioned and secured at opposite ends of the relief 94 transversely sandwiching the riser body 12. The vertical, end-shoulders 97 of the mounted ear structures 94 extend above the cylindrical volume coaxial with the semi-cylindrical volume so defined, and are spaced to comfortably receive and constrain the side edges of the flexure section of the bow limb 13 for aligning the centerline of the bow limb 13 with the reference plane of the bow. A limb-pod cylinder 93, preferably composed of a low friction uniformly, resilient synthetic engineering polymer material having a radius and length appropriately adjusted, is snugly seated in the concave semi-cylindrical volume of limb-pod cradle 81, to provide at least a convex, semi-cylindrical flexure surface that rises substantially above the end surfaces 97 & 98 of the mount face 16 in front and behind the concave the semi-cylindrical relief 94. In fact, as illustrated the rearward surface 98 preferably should incline inward away from the extending bow limb 13 at an angle sufficient to allow for inward flexure of the bow-limbs 13 around the limb-pod cylinder 93 at a designed minimum, or low draw-weight position for the particular bow. (See FIG. 15.)

The radius of the concave semi-cylindrical relief 94, and the shouldered concave semi-cylindrical ear structures 96 of the limb-pod cradle structure 81 should be selected with reference to the elastic strain or flexure properties/parameters of an anticipated range of resilient bow limbs 13 designed for the particular bow. In particular, a bow-limb flexing around the provided convex cylindrical surface, as the bow is drawn compresses the limb-pod cylinder 93 seated in the cradle structure 81. The compressive response provided by the under lying limb-pod cylinder 93 must be radially and transversely uniform for holding the flexing bow limb without twisting longitudinally well above the top edges of the receiving semi-cylindrical volume of the cradle structure 81.

Polyoxymethylene (POM) plastic blends have been found to be suitable materials for limb-pod cylinders 93. POM plastic blends have strength, toughness, dimensional stability, good machinability, good wear characteristics. POM plastics have modulus of elasticity range of 1.30-3.60 GPa, flexure modulus ranging of 1.10-3.38 GPa, and relatively low coefficients of friction ranging from 0.190-0.300. POM plastics include polyacetal, acetal resin, polytrioxane, polyformaldehyde, and paraformaldehyde and are identified in commercial trade by the trademarks Delrin®, Kepital®, Celcon®, Hostaform®, Iupitaland® and Ultraform®. For example, Delrin® AF Blend is a combination of Teflon* fibers uniformly dispersed in Delrin® acetal resin available from E. I. du Pont de Nemours and Company Corporation (DuPont®).

In fact, it was found that properties of a limb-pod cylinder ⅝", 0.685 inches, in diameter machined from a Delrin® blend of a polyoxymethylene plastic (POM) available from DuPont® synergistically responded to compressive load and release stress of constrained of flexing bow limbs produced for a particular proto-type bow 11. The bow was easy to tune, and comfortable to use. The response both on draw and release was smoother, and shots the were repeatable and more accurate. Post arrow launch vibrations of the bow components were also significantly decreased.

It should be recognized that skilled compound bow designer can specify different configurations for the described mechanisms implementing the invented improvements for compound bows that performs substantially the same function, in substantially the same way to achieve substantially the same result as those components described and specified in this application. Similarly, the respective elements described for effecting the desired functionality could be configured differently, per constraints imposed by different mechanical systems, yet perform substantially the same function, in substantially the same way to achieve substantially the same result as those components described and specified above by the Applicants. Accordingly, while mechanical components suitable for implementing the invented compound bow improvements for may not be exactly as described herein, they may fall within the spirit and the scope of invention as described and set forth in the appended claims.

I claim:

1. A cable guard for separating and holding a crossing locus of two inside cable segments of a compound bow away from a draw and release, arrow launching plane of an outside drawstring cable segment, comprising, in combination:

(a) a post mounted, extending back from a riser of the bow toward the drawstring cable segment spaced away from the draw and release, arrow launching plane of the outside drawstring cable segment;

(b) a pair of axle mounts mounted on and supported by the post extending transversely out from the post;

(c) a pair of spaced cable glide-axles supported between the pair of axle mounts each providing a cable race where a first crossing inside cable segment is received between the cable glide-axles and a second crossing inside cable segment is received between a cable glide-axle and the post, whereby, the first and second inside cables are separated apart, and held away from the draw and release arrow launching plane of the outside drawstring cable segment, and the crossing locus of the inside cables can move in space back and forth though the cable guard separated by the cable glide-axles as the drawstring cable segment is drawn and released for launching arrows.

2. The cable guard of claim 1 wherein the axle mounts slide back and forth on the post as the drawstring cable segment is drawn and released for launching an arrow, and the cable races provided by the glide-axles supported between the axle mounts have a width at least equal to a maximum angular spread of the crossing, inside cables segments translating through the cable guard.

3. The cable guard of claim 1 wherein the axle mounts are respectively secured at fixed positions on the post, and the cable races provided by the glide-axles between the axle mounts each having a width at least equal to a maximum distance the respective first and second crossing inside cables segments of the bow will translate back and forth in respective planes established by the particular supported glide-axle as the particular received drawstring cable segment is drawn and released for launching an arrow.

* * * * *